US009466164B2

(12) United States Patent
Kagerer

(10) Patent No.: US 9,466,164 B2
(45) Date of Patent: Oct. 11, 2016

(54) MONITORING AND CONTROL DEVICE FOR A DOOR UNIT

(71) Applicant: FRABA N.V., SG Heerlen (NL)

(72) Inventor: Bernd Kagerer, Krefeld (DE)

(73) Assignee: FRABA N.V., SG Heerlen (NL)

( * ) Notice: Subject to any disclaimer, the term of this patent is extended or adjusted under 35 U.S.C. 154(b) by 26 days.

(21) Appl. No.: 14/417,795

(22) PCT Filed: Jul. 25, 2013

(86) PCT No.: PCT/EP2013/065734
§ 371 (c)(1),
(2) Date: Jan. 28, 2015

(87) PCT Pub. No.: WO2014/019937
PCT Pub. Date: Feb. 6, 2014

(65) Prior Publication Data

US 2015/0243115 A1 Aug. 27, 2015

(30) Foreign Application Priority Data

Jul. 30, 2012 (DE) ..... 10 2012 106 889

(51) Int. Cl.

| | |
|---|---|
| ***E05F 15/73*** | (2015.01) |
| ***G07C 9/00*** | (2006.01) |
| ***E05F 15/40*** | (2015.01) |
| ***E05F 15/43*** | (2015.01) |

(52) U.S. Cl.
CPC ..... *G07C 9/00896* (2013.01); *E05F 15/40* (2015.01); *E05F 15/43* (2015.01); *E05F 2015/434* (2015.01); *E05Y 2800/71* (2013.01); *E05Y 2800/73* (2013.01); *E05Y 2900/106* (2013.01); *G07C 2009/00928* (2013.01)

(58) Field of Classification Search
CPC ..... E05F 15/43; E05F 15/60; E05F 15/603; E05F 15/70; E05F 15/73; E05Y 2400/36; E05Y 2400/50; E05Y 2400/51; E05Y 2400/514; G01S 13/04
See application file for complete search history.

(56) References Cited

U.S. PATENT DOCUMENTS

| | | | | |
|---|---|---|---|---|
| 5,278,480 | A * | 1/1994 | Murray | G05B 19/42 318/266 |
| 5,770,934 | A * | 6/1998 | Theile | H02H 7/0851 318/466 |
| 5,789,887 | A * | 8/1998 | Elischewski | G05B 19/0428 318/286 |
| 2002/0036476 | A1 * | 3/2002 | Zengguang | G01S 17/026 318/480 |
| 2005/0184695 | A1 | 8/2005 | Chen | |
| 2005/0207616 | A1 | 9/2005 | Brad et al. | |
| 2006/0112643 | A1 * | 6/2006 | Yokomori | E05F 15/646 49/360 |
| 2008/0084300 | A1 | 4/2008 | Albers et al. | |

(Continued)

FOREIGN PATENT DOCUMENTS

| | | |
|---|---|---|
| DE | 299 12 572 U1 | 9/1999 |
| DE | 20 2008 009 320 U1 | 9/2008 |
| DE | 10 2008 044 990 A1 | 3/2010 |

*Primary Examiner* — Andrew Bee
(74) *Attorney, Agent, or Firm* — Norman B. Thot

(57) ABSTRACT

A monitoring and control device for a door unit includes a sensor control device comprising an output side and an input side. At least one sensor assembly is arranged in a region of the door unit. The at least one sensor assembly is connected to and controlled by the sensor control device, and is configured to measure at least one of a 3D signal and a distance signal A drive device comprises a drive control unit connected with the output side and with the input side of the sensor control device. The drive device is configured to move the door unit.

19 Claims, 1 Drawing Sheet

(56) References Cited

U.S. PATENT DOCUMENTS

2008/0225263 A1 9/2008 Albers et al.
2008/0231442 A1* 9/2008 Schafer ..... E06B 9/68 340/540
2010/0050526 A1* 3/2010 Ozaki ..... E05F 15/0013 49/28
2011/0060466 A1* 3/2011 Tandrow ..... G05B 19/19 700/275
2012/0150487 A1 6/2012 De Coi

* cited by examiner

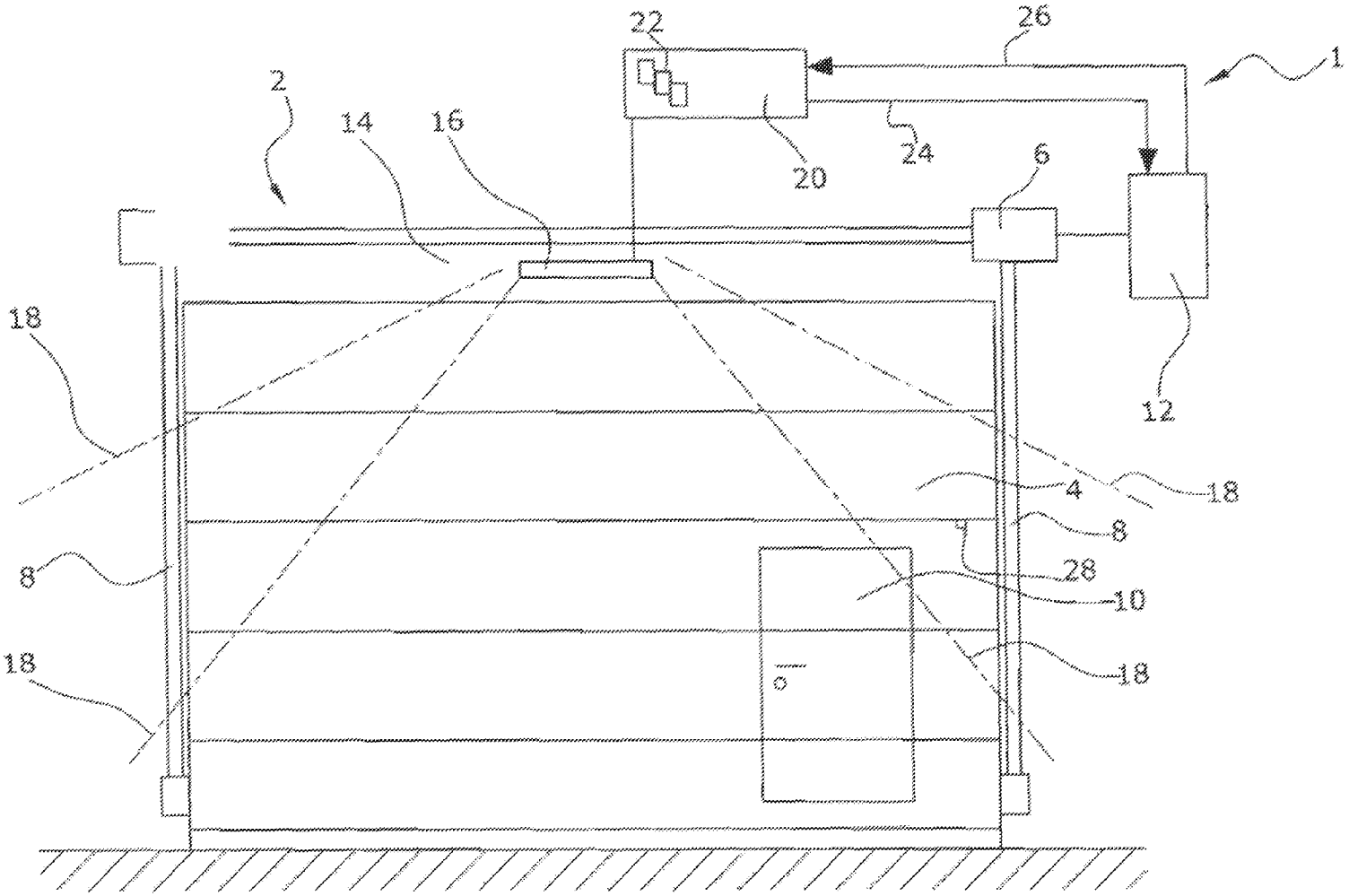
1
26
12
6
24
20
22
16
14
2
18
4
8
28
10
18
18
8
18

MONITORING AND CONTROL DEVICE FOR A DOOR UNIT

CROSS REFERENCE TO PRIOR APPLICATIONS

This application is a U.S. National Phase application under 35 U.S.C. §371 of International Application No. PCT/EP2013/065734, filed on Jul. 25, 2013 and which claims benefit to German Patent Application No. 10 2012 106 889.5, filed on Jul. 30, 2012. The International Application was published in German on Feb. 6, 2014 as WO 2014/019937 A1 under PCT Article 21(2).

FIELD

The present invention relates to a monitoring and control device for a door unit, such as a roller or sectional door, which includes at least one sensor assembly arranged in the region of the door unit which is controlledly connected with a sensor control device, wherein the door unit is adapted to be moved by means of a drive device including a drive control unit, and wherein at the output side the sensor control device is connected with the drive control unit.

BACKGROUND

Such monitoring and control devices have previously been described. DE 20 2008 009 320 U1 describes, for example, a monitoring device which includes an optical switching rail having a monitoring sensor to prevent risks posed by moving machine parts in, for example, the door region. The monitoring device also comprises a sensor assembly for a wicket door for detecting the closed position of a wicket door. A slack rope switch is also provided which is activated when sliding of the door is impeded by damaged lateral slide rails which would lead to slackening of the towing rope of the door. So-called crash switches may additionally (e.g., in the case of plastic sheet doors) detect a jumping of the doors out of the sliding rails to stop a dangerous movement. The above shows that a number of sensor assemblies and/or detection devices have been provided to perform various safety functions. Most of these sensors or detection devices are cabled with the aid of spiral cables or are adapted to be operated in a wireless manner, which requires that they provide their own power sources. The plurality of such sensor detection assemblies require a large installation effort while being susceptible to malfunctioning due to complex electrical contacting.

SUMMARY

An aspect of the present invention is to provide a monitoring and control device for a door unit which has a simpler design and which requires less installation effort.

In an embodiment, the present invention provides a monitoring and control device for a door unit which includes a sensor control device comprising an output side and an input side. At least one sensor assembly is arranged in a region of the door unit. The at least one sensor assembly is connected to and controlled by the sensor control device, and is configured to measure at least one of a 3D signal and a distance signal A drive device comprises a drive control unit connected with the output side and with the input side of the sensor control device. The drive device is configured to move the door unit.

BRIEF DESCRIPTION OF THE DRAWINGS

The present invention is described in greater detail below on the basis of embodiments and of the drawing in which:

FIG. 1 shows a schematic representation of a monitoring and control device for a door unit which is configured as a sectional door.

DETAILED DESCRIPTION

In an embodiment of the present invention, the sensor device is designed so that a 3D signal and/or a simple distance signal can be measured, wherein the sensor control device is connected with a drive control unit at the input and output sides. The input-side connection of the sensor control device with the motor control unit allows a plurality of input signals and/or information to be provided which, in connection with the 3D signal from the sensor assembly, provide all necessary detection functions in the region of the door unit.

In an embodiment of the present invention, a wicket door or a wicket window may, for example, be provided which is adapted to be monitored by the sensor assembly. If the sensor device detects that the wicket door or the wicket window is still open, a warning signal may issue and/or the motor control unit may receive a signal communicating that no action of the motor is to be carried out.

In an embodiment of the present invention, the sensor assembly can, for example, be arranged at a non-moveable housing portion at the periphery above a door leaf of the door unit. This allows for a detection of the position of the door, a malposition of the door (which also includes a jumping of the door out of the slide rail), obstacles in the opening or closing path of the door, defects at a door leaf of the door, and persons or vehicles in the door region.

A motor speed and/or a motor current and/or a motor voltage and/or a door target positions and/or door target states etc. can be provided by the drive control unit as an input signal for the sensor control device. On the basis of these input signals, the sensor control device can provide, evaluations and thus output signals with regard to the state of movement of the door, the position of the door, and the velocity of the door at which it is moved into a specific position. In an embodiment of the present invention, characteristic maps, such as a motor speed-door velocity, a motor speed-door position, door target positions, door target states etc., are stored in the sensor control device so that an evaluation can be carried out on the basis of reference information. It can be advantageous when the motor speed is adapted to be compared with a change in the distance of the door leaf in the sensor control device so that, in the case of a deviation, an output signal can be issued. It is also conceivable that a target position or a target location of the door leaf is adapted to be compared with the 3D signal and/or distance signal in the sensor control device so that an output signal can be issued in the case of a deviation. In an embodiment of the present invention, a movement of the door leaf is adapted to be controlled as a function of the 3D signal. A movement of the door leaf is further adapted to be controlled as a function of the 3D signal. Part of the above information may be generated and stored by the sensor control device. A teaching mode or a teaching run may be advantageous. This information may also already be factory-set in the sensor control device.

In an embodiment of the present invention, the sensor assembly may, for example, comprise a distance recognition device. The distance recognition device may comprise a distance sensor which operates according to the "triangulation principle".

In an embodiment of the present invention, the sensor assembly may, for example, comprise a 3D sensor. The 3D sensor may here, for example, operate according to the "time of flight" or the "triangulation principle".

In an embodiment of the present invention, a single sensor assembly may, for example, be provided for the door unit. The sensor assembly here monitors the overall door region in front of and behind the door leaf of the door unit.

Marking means may be provided on specific measuring surfaces to detect a malposition of the door leaf (and thus the jumping of the door leaf out of the slide rail) or the opening angle of a wicket door. It can here be advantageous to project these marking means. It is further conceivable that the marking means are composed of reflectors and/or an illumination. It is here possible to detect changes in the marking. A marking which is attached slightly above the overall door edge would, for example, be interrupted by the opening of the wicket door and the opening process would be detected. It is to be understood that this is only one example of the help provided by such marking means.

In an embodiment of the present invention, the door position and location in the room is adapted to be monitored by the sensor control device.

The present invention will now be described in detail with reference to FIG. 1.

FIG. 1 shows a monitoring and control device 1 for a door unit 2 including a door leaf 4 configured as a sectional door. The door leaf 4 may be moved into an open position, a closed position, or an intermediate position by a drive device 6 via laterally arranged traction ropes 8. The door leaf 4 of the door unit 2 is in a closed position in the shown embodiment. The door leaf 4 comprises a wicket door 10 which allows for a simple entering of a room without opening the door leaf 4.

The drive device 6 is connected with a drive control unit 12 in a known manner.

A sensor assembly 16 configured as a 3D sensor is provided at a non-movable housing portion 14 which monitors both the region 18 in front of the door illustrated and the region behind the door. The sensor assembly 16 further includes a distance recognition device for this purpose.

The sensor assembly 16 is controlledly connected with a sensor control device 20 in which information 22, in particular characteristic maps, such as motor speed-door velocity, motor speed-door position or door target positions and door target states (open, closed, location etc.), are stored. The sensor control device 20 is connected with the drive control unit 12 both on the output side 24 and the input side 26. It is also possible to directly process the input-side information in the drive control unit 12 so that the sensor control unit 20 need not comprise a physical input. The drive control unit 12 performs the comparison functions (target-actual etc.) in this case. This is above all of interest when this information is already available in the drive control unit 12 for other reasons. It is also possible to accommodate the sensor assembly 16 in the same housing or even in the same hardware as the sensor control device 20. Due to the possibility of transmitting input signals 26, such as a motor speed and/or a motor current and/or a motor voltage, to the sensor control device 20, it is possible to cover all the aforementioned monitoring functions in connection with the single sensor assembly 16. The plurality of sensor assemblies can be reduced to one sensor in this case, and the complex cabling may be omitted.

It may in particular be advantageous in the monitoring of the door blade 4 and the wicket door 10 to provide a marking 28 which allows for a monitoring by the sensor assembly 16. The marking 28 may of course also be composed of projected patterns, such as stripe patterns. Another possibility would be the attachment of reflectors or other illumination.

The present invention is not limited to embodiments described herein; reference should be had to the appended claims.

What is claimed is:

1. A monitoring and control device for a door unit, the monitoring and control device comprising:

a sensor control device comprising an output side and an input side;

at least one sensor assembly arranged in a region of the door unit, the at least one sensor assembly being connected to and controlled by the sensor control device, and being configured to measure at least one of a 3D signal and a distance signal, the at least one sensor assembly comprising a 3D sensor arranged at a non-movable housing portion and being configured to monitor a first region in front of the door unit and a second region behind the door unit; and a drive device comprising a drive control unit connected with the output side and with the input side of the sensor control device, the drive device being configured to move the door unit.

2. The device as recited in claim 1, further comprising a wicket door or a wicket window, the at least one sensor assembly being further configured to monitor the wicket door or the wicket window.

3. The device as recited in claim 1, wherein the door unit comprises a non-movable housing portion and a door leaf, and the at least one sensor assembly is arranged at a periphery above the door leaf of the non-movable housing portion of the door unit.

4. The device as recited in claim 3, wherein the sensor control device further comprises an input signal, the input signal being provided by the drive control unit as at least one of a motor speed, a motor current, a motor voltage, a door target position, and a door target state.

5. The device as recited in claim 4, wherein the sensor control device is configured to compare the motor speed with a change in a distance of the door leaf, and to issue an output signal if a deviation is measured.

6. The device as recited in claim 4, wherein the sensor control device is configured to compare a target position of the door leaf or a target location of the door leaf with at least one of the 3D signal and the distance signal, and to issue an output signal if a deviation is measured.

7. The device as recited in claim 6, wherein the device is configured to control a movement of the door leaf based on the 3D signal.

8. The device as recited in claim 1, wherein in the sensor control device is further configured to store information.

9. The device as recited in claim 1, wherein the information comprises a characteristic map.

10. The device as recited in claim 9, wherein the characteristic map is selected from at least one of a motor speed-door velocity and a motor speed-door position.

11. The device as recited in claim 1, wherein the device is configured to control a movement of the door leaf based on a presence of an object.

12. The device as recited in claim 1, wherein the at least one sensor assembly comprises a distance recognition device.

13. The device as recited in claim 12, wherein the distance recognition device comprises a distance sensor operating according to a triangulation principle.

14. The device as recited in claim 1, wherein the 3D sensor operates according to a time of flight principle.

15. The device as recited in claim 1, wherein the at least one sensor assembly is a single sensor assembly.

16. The device as recited in claim 1, further comprising a marking provided on a measuring surface.

17. The device as recited in claim 16, wherein the marking is front projected.

18. The device as recited in claim 16, wherein the marking comprises at least one of a reflector and an illumination.

19. The device as recited in claim 1, wherein a door position of the door unit and a spatial position of the door unit are monitored by the sensor control device.

* * * * *